United States Patent [19]

Otsuka et al.

[11] Patent Number: 4,752,549

[45] Date of Patent: Jun. 21, 1988

[54] ELECTROPHOTOGRAPHIC PHOTORECEPTOR HAVING A PROTECTIVE LAYER

[75] Inventors: Shigenori Otsuka, Omiya; Kohki Furuya, Yokohama; Mamoru Nozomi, Machida, all of Japan

[73] Assignee: Mitsubishi Chemical Industries Limited, Tokyo, Japan

[21] Appl. No.: 924,282

[22] Filed: Oct. 27, 1986

[30] Foreign Application Priority Data

Nov. 5, 1985 [JP] Japan ..... 60-247678

[51] Int. Cl.[4] ..... G03G 5/14

[52] U.S. Cl. ..... 430/58; 430/64; 430/66

[58] Field of Search ..... 430/66, 67, 58, 64

[56] References Cited

U.S. PATENT DOCUMENTS 4,565,760 1/1986 Schank ..... 430/67
4,658,756 4/1987 Ito et al. ..... 430/67

FOREIGN PATENT DOCUMENTS 122085 10/1974 Japan ..... 430/67
53-236369 3/1978 Japan .

*Primary Examiner*—John L. Goodrow
*Attorney, Agent, or Firm*—David G. Conlin; Ernest V. Linek

[57] ABSTRACT

An electrophotographic photoreceptor according to this invention has an electrically conductive support, a charge-generation layer, a charge-transport layer and a protective layer which consists essentially of a thermosetting silicone resin and a polyvinyl acetal resin.

The electrophotographic photoreceptor according to this invention has improved durability in repeated copying operations due to the inclusion of the polyvinyl acetal resin into the protective layer.

16 Claims, No Drawings

ELECTROPHOTOGRAPHIC PHOTORECEPTOR HAVING A PROTECTIVE LAYER

FIELD OF THE INVENTION

This invention relates to an electrophotographic photoreceptor. More specifically, it relates to a photoreceptor having improved durability in repeated copying operations.

BACKGROUND OF THE INVENTION

An electrophotographic photoreceptor has an electrically conductive support and a photosensitive layer formed thereon which includes an inorganic or organic photoconductor.

Recently, double layer photoreceptors with a combination of a charge-generation layer and a charge-transport layer have been shown to have higher sensitivity and some of them have been commercially employed. Those photoreceptors in which an organic material is used as the charge-transporting medium and which have high charge acceptance in addition to higher sensitivity, have been highly investigated.

An electrophotographic photoreceptor is subjected to repeated copying operation which include charging by a corona charging device, exposing, developing, transferring and cleaning steps and is required to have excellent durability in such repeated copying operations. When the above-mentioned prior photoreceptors, especially those photoreceptors having an organic charge-transporting medium are subjected to the repeated copying operation (for example, several thousands to several ten thousands times), however, both abrasion and cracks are observed in the photoreceptor due to practical loads such as development with the toner, friction with paper and/or cleaning means and therefore the printing-resistance is actually limited.

The above-mentioned phenomena are mainly caused by the low surface strength of the charge-transport layer. One attempt at increasing the surface strength of the charge-transport layer, i.e., the selection of a suitable polymeric binder (which is generally included together with a charge-transporting material in the charge-transport layer) resulted in failure since a large amount of the charge-transporting material was doped therein.

A method for providing a protective layer on the charge-transport layer to improve the surface strength of the photoreceptor has also been proposed. In this method, the protective layer is formed by coating the charge-transport layer with a solution in which a thermo-setting silicone resin is dissolved and then setting the resin by heating. However, this protective layer has problems such as the occurance of cracks and cuts as well as an ease of separation from the charge-transport layer since the silicone resin protective layer could unsatisfactorily adhere to the charge-transport layer. Further, the protective layer may partially peel off the charge-transport layer due to the pressure of the cleaning means and the like.

A method for providing an adhesive layer between the protective layer and the charge-transport layer to improve the adhesive strength therebetween has been also proposed. This method is not practical since it offers undesirable effects such as increase in the residual potential and the development fog by the presence of the adhesive layer.

Thus, there is a strong need for increasing the adhesive strength between the protective layer and the charge-transport layer without any of the above-described undesirable effects that can provide the electrophotographic photoreceptor with improved durability for repeated copying operations.

An object of this invention is to provide such an electrophotographic photoreceptor having improved durability in repeated copying operations by improving the adhesive strength between the protective layer and the charge-transport layer.

SUMMARY OF THE INVENTION

In an electrophotographic photoreceptor according to this invention having an electrically conductive support, a charge-generation layer, a charge-transport layer and a protective layer, the protective layer consists essentially of a thermo-setting silicone resin and a polyvinyl acetal resin.

DETAILED DESCRIPTION OF THE PREFERRED EMBODIMENTS

The electrically conductive support may be made of a metal material such as aluminum, stainless steel, copper and nickel. Alternatively, the support may be made of an insulating material such as plastic film or paper carrying an electrically conductive layer thereon. The electrically conductive layer includes an electrically conductive substance such as aluminum, copper, palladium, tin oxide and indium oxide.

The charge-generation layer in which a photoconductor is included is formed on the support by vapor-depositing or sputtering of the photoconductor. The photoconductor may be an inorganic or organic photoconductor. Representative photoconductors include selenium, its alloys, cadmium sulfide, zinc oxide and organic dyes such as phthalocyanine, perillene, indigo, quinacridone, bis-azo compounds and their derivatives. Alternatively, the charge-generation layer may be formed on the support by coating a solution in which the photoconductor and optionally a polymeric binder are dispersed.

The charge-generation layer has generally a 0.1 to 1 micron thickness, preferably a 0.15 to 0.6 micron thickness.

A barrier layer may be provided between the support and the charge-generation layer. A representative barrier layer is made of a metal oxide such as aluminum oxide or a resin such as polyamide, polyurethane, cellulose and casein.

The charge-transport layer in which a charge-transporting material is included is coated on the charge-generation layer by coating a solution in which the charge-transporting material and optionally the polymeric binder are dispersed. Any known charge-transporting material can be used. The representative charge-transporting agents include heterocyclic compounds such as indole, carbazole, imidazole, oxazole, thiazole, oxadiazole, pyrazole, pyrazoline, thiadiazole, benzoxazole, benzothiazole, benzimidazole and the like; aromatic hydrocarbons such as benzene, naphthalene, anthracene, fluorene, perillene, pyrene, phenylanthracene, styryl anthracene and the like; their substituted derivatives having any substituents such as alkyl, alkoxy, amino or substituted amino groups; the other derivatives such as triarylalkane, triarylamino, chalcone derivatives, hydrazine derivatives, hydrazones and the like; and their polymers such as polyvinyl carbazole, polystyryl anthracene and the like.

Any known polymeric binder can be used. The representative polymeric binders include homopolymers or copolymers of a vinyl compound such as styrene, vinyl chloride, acrylic or methacrylic esters and the like, phenoxy resin, polyvinyl acetal, polyvinyl butyral, polyester, polycarbonate, cellulose ester, silicone resin, urethane resin, unsaturated polyester and the like, as well as their partially cross-linked cured materials.

The charge-transport layer may include known additives such as anti-oxidants, sensitizers, and the like.

The charge-transport layer has generally a 5 to 40 micron thickness, preferably a 10 to 30 micron thickness.

The protective layer of the present invention, which consists essentially of a thermo-setting silicone resin and a polyvinyl acetal resin, is coated on the charge-transport layer.

The thermo-setting silicone resin which is included in the protective layer of the present invention may be prepared by subjecting a silane compound to hydrolysis and condensation. In the preparation of the silicone resin, one or more silane compounds may be selected from the group consisting of, dialkoxy dialkyl silane, trialkoxy alkyl silane and tetraalkoxy silane, which are preferably used since these silane compounds have high reactivities so as to easily set on heating and the resultant protective layer shows very high surface strength. The alkyl or alkoxy group in the silane compound means lower (generally $C_{1-4}$) alkyl or alkoxy group. Although a mixture of silane compounds may be used in the preparation of silicone resin, the mixture of trialkoxy alkyl silane and tetraalkoxy silane in which the content of the tetraalkoxy silane is more than 50% by weight is preferable. The molecular weight of the silicone resin before thermo-setting is generally in a range of several hundreds to several hundred thousands.

The polyvinyl acetal resin which is included in the protective layer of the present invention may be prepared by subjecting polyvinyl alcohol resin obtained by partial hydrolysis of polyvinyl acetate to acetal formation. The preferable degree of acetal formation is more than 40%. The representative polyvinyl acetal resin includes polyvinyl butyral, polyvinyl formal, polyvinyl acetacetal and polyvinyl propylacetal resin, among of which the polyvinyl butyral resin is preferred.

The polyvinyl acetal resin is generally included in the protective layer in an amount of 0.5 to 30% by weight, preferably 3 to 20% by weight based on the total weight of the protective layer. In lesser amounts, increase of the adhesive strength is not satisfactory, while in greater amounts, natural surface strength is impaired.

The protective layer may include a filler for further improving the surface strength such as colloidal silica and/or other known additives, in addition to the combination of silicone resin and polyvinyl acetal resin.

The protective layer of the present invention may be formed by dissolving a composition consisting essentially of the thermo-setting silicone resin and the polyvinyl acetal resin in a suitable solvent, for example, alcohols such as isobutanol and isopropanol or esters such as ethyl acetate, methyl acetate and methylcellosolve acetate so as to prepare a coating solution, coating the coating solution on the charge-transport layer and then setting the resin by heating.

The protective layer has a 0.1 to 5 micron thickness, preferably a 0.5 to 2 micron thickness.

An electrophotographic photoreceptor prepared according to this invention can be widely applied in the electrophotographic field, for example, in copying machines, printers having laser, CRT or LED as the optical source, and the like.

EXAMPLES

The following examples will further describe various preferred embodiments of this invention and includes comparative examples.

All parts are by weight unless otherwise specified.

Comparative Example 1

Ten parts of bis-azo compound having the following formula:

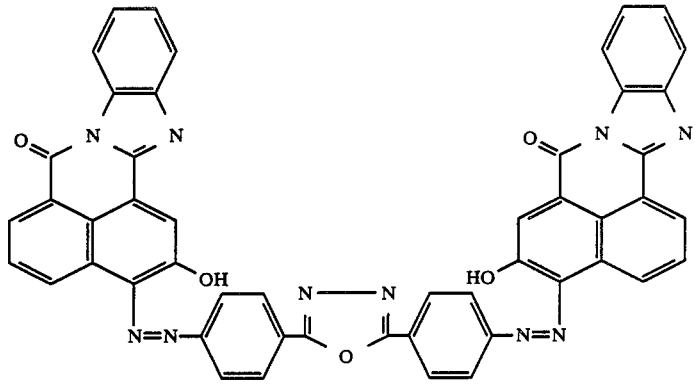

5 parts of phenoxy resin (PKHH, manufactured by Union Carbide Corp.) and 5 parts of polyvinyl butyral resin (BH-3, manufactured by Sekisui Chemical Co., Ltd.) were dispersed in 100 parts of tetrahydrofuran with a sand grinder to prepare a coating solution. A cylinder made of planished aluminum was immersed in the thus-prepared solution so that the dry thickness of the charge-generation layer was 0.4 micron. Thus, the charge-generation layer was formed on the support.

While, 100 parts of hydrazone compound having the following formula:

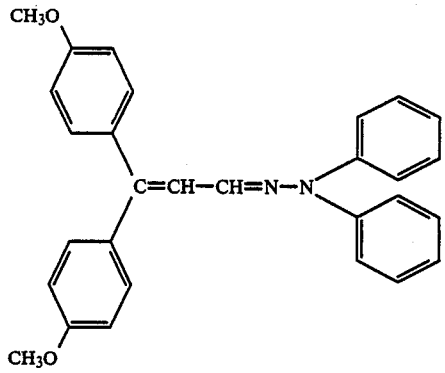

and 100 parts of polycarbonate resin (Novalex® 7030A, manufactured by MITSUBISHI CHEMICAL INDUSTRIES LTD.) were dissolved in 1000 parts of tetrahydrofuran to prepare a coating solution. The above cylinder was immersed in the thus-prepared solution so that the dry thickness of the charge-transport layer was 20 microns. Thus, a photoreceptor without the protective layer (sample No. A) was prepared.

Comparative Example 2

A protective layer was coated on the charge-transport layer of the photoreceptor (sample No. A) by immersing in a coating solution so that the dry thickness of the protective layer was 1 micron and then heating at 130° C. for 30 minutes to allow thermo-setting. The coating solution used was prepared by diluting a silicone resin (Tosgard 510, mainly containing the condensate obtained after hydrolyzing a mixture of trialkoxy alkyl silane and tetraalkoxy silane, manufactured by TOSHIBA SILICONE CO., LTD.) with isopropanol until the solid matter concentration was 5%. Thus, a photoreceptor with a protective layer consisting of the silicone resin at a 1 micron thickness (sample No. B) was prepared.

Example 1

A protective layer was coated on the charge-transport layer of the photoreceptor (sample No. A) in the same manner as described in Comparative Example 2, except that the coating solution was changed. The coating solution used was prepared by diluting the same silicone resin (Tosgard 510, manufactured by TOSHIBA SILICONE CO., LTD.) with isopropanol until the solid matter concentration was 5% and adding and dissolving a polyvinyl butyral resin (Eslex® BL-S, manufactured by Sekisui Chemical Co., Ltd.) in an amount of 5 grams per 1000 grams of the resultant diluted solution. Thus, a photoreceptor with a protective layer consisting essentially of a silicone resin and a polyvinyl butyral resin, having a 1 micron thickness (sample No. C) was prepared.

Example 2

A protective layer was coated on the charge-transport layer of the photoreceptor (sample No. A) in the same manner as described in Comparative Example 2, except that the coating solution was changed. The coating solution used was prepared by diluting a silicone resin (X-12-22, mainly containing the condensate obtained after hydrolyzing trialkoxy alkyl silane, manufactured by Shin-Etsu Chemical Co., Ltd.) with isopropanol until the solid matter concentration was 5% and adding and dissolving the polyvinyl butyral resin (Eslex® BL-S, manufactured by Sekisui Chemical Co., Ltd.) in an amount of 5 grams per 1000 grams of the resultant diluted solution. Thus, a photoreceptor with a protective layer consisting essentially of a silicone resin, and a polyvinyl butyral resin and having a 0.7 micron thickness (sample No. D) was prepared.

Comparative Example 3

The photoreceptor (sample No. E) was prepared in the same manner as described in Example 2, provided that the addition of the polyvinyl butyral resin was omitted.

Example 3

(i) The surface strength of each of the photoreceptors (sample Nos. A to C) was tested using a pencil.

The surface of the photoreceptor (sample No. B) was damaged by a pencil with the hardness B. On the other hand, the surface of the photoreceptor (sample No. A or C) was damaged only by the pencil with a hardness more than 4H.

As the above results, it was found that the photoreceptor according to this invention has the high surface strength.

(ii) The adhesive property of the protective layer in each of the photoreceptors was tested by putting a commercial adhesive tape thereon and then peeling it off.

There were cracks on the protective layer of the photoreceptor (sample No. B or E) and the protective layer easily peeled off. On the other hand, the separation of the protective layer from the charge-transport layer in the photoreceptor (sample No. C and D) was not observed.

As the above results, it was found that the protective layer of the photoreceptor according to this invention firmly adhere.

(iii) Each of the photoreceptors (sample Nos. A to C) was subjected to 100,000 copying operations using a commercial copying machine to test their durability.

In the case of photoreceptor sample No. A, a gradual lowering in the density and the surface potential was observed and the resultant copies were not clear. Also the thickness of the photosensitive layer was reduced to 6 microns.

In the case of photoreceptor sample No. B, a partial separation of the protective layer was observed and the resultant copies were not locally clear.

In the case of photoreceptor sample No. C, the separation of the protective layer and cracks thereon, as well as the lowering of the thickness of the photosensitive layer, were not observed and the resultant copies could be usually clear.

As the above results, it was found that the photoreceptor according to this invention has high durability in repeated copying operations.

Effect of the Invention

The electrophotographic photoreceptor according to this invention has a protective layer with high surface strength and high adhesive strength and therefore the electrophotographic photoreceptor according to this invention has improved durability in repeated copying operations.

What is claimed is:

1. In an electrophotographic photoreceptor having an electrically conductive support, a charge-generation layer, a charge-transport layer and a protective layer, the protective layer consists essentially of a thermo-setting silicone resin and a polyvinyl acetal resin.

2. The photoreceptor according to claim 1, wherein the polyvinyl acetal resin is prepared by subjecting a polyvinyl alcohol resin to acetal formation.

3. The photoreceptor according to claim 2, wherein the degree of acetal formation in the polyvinyl acetal resin is more than 40%.

4. The photoreceptor according to any one of claims 1 to 3, wherein the polyvinyl acetal resin is polyvinyl butyral, polyvinyl formal, polyvinyl acetacetal or polyvinyl propylacetal resin.

5. The photoreceptor according to claim 4, wherein the polyvinyl acetal resin is polyvinyl butyral resin.

6. The photoreceptor according to claim 1, wherein the polyvinyl acetal resin is contained in an amount of 0.5 to 30% by weight based on the total weight of the protective layer.

7. The photoreceptor according to claim 6, wherein the polyvinyl acetal resin is contained in an amount of 3 to 20% by weight based on the total weight of the protective layer.

8. The photoreceptor according to claim 1, wherein the thremo-setting silicone resin is prepared by subjecting one or more silane compound selected from dialkoxy dialkyl silane, trialkoxy alkyl silane or tetraalkoxy silane to hydrolysis and condensation.

9. The photoreceptor according to claim 1, wherein the protective layer comprises further a filler and/or additives.

10. The photoreceptor according to claim 1, wherein the protective layer is formed by dissolving a composition consisting essentially of a thermo-setting silicone resin and a polyvinyl acetal resin in a solvent so as to prepare a coating solutinon, coating the coating solution on the charge-transport layer and then setting on heating.

11. The photoreceptor according to claim 1, wherein the protective layer has a 0.1 to 5 microns thickness.

12. The photoreceptor according to claim 11, wherein the protective layer has a 0.5 to 2 microns thickness.

13. The photoreceptor according to claim 1, wherein the support is made of a metal material or an insulating material carrying an electrically conductive layer thereon.

14. The photoreceptor according to claim 1, wherein the charge-generation layer includes a photoconductor and optionally a polymeric binder.

15. The photoreceptor according to claim 1, wherein the charge-transport layer includes a charge-transporting material and optionally a polymeric binder and additives.

16. The photoreceptor according to claim 1, wherein a barrier layer is provided between the support and the charge-generation layer.

* * * * *